US009834227B2

(12) United States Patent
Becker et al.

(10) Patent No.: US 9,834,227 B2
(45) Date of Patent: Dec. 5, 2017

(54) RAIL SYSTEM, INCLUDING A RAIL-BOUND VEHICLE MOVABLE ALONG A RAIL TRACK

(71) Applicant: SEW-EURODRIVE GMBH & CO. KG, Bruchsal (DE)

(72) Inventors: Günter Becker, Östringen (DE); Dirk Degen, Bruchsal (DE)

(73) Assignee: SEW-EURODRIVE GMBH & CO. KG, Bruchsal (DE)

( * ) Notice: Subject to any disclaimer, the term of this patent is extended or adjusted under 35 U.S.C. 154(b) by 233 days.

(21) Appl. No.: 14/653,026

(22) PCT Filed: Nov. 13, 2013

(86) PCT No.: PCT/EP2013/003414
§ 371 (c)(1),
(2) Date: Jun. 17, 2015

(87) PCT Pub. No.: WO2014/094943
PCT Pub. Date: Jun. 26, 2014

(65) Prior Publication Data

US 2015/0336589 A1 Nov. 26, 2015

(30) Foreign Application Priority Data

Dec. 18, 2012 (DE) ..... 10 2012 024 693

(51) Int. Cl.
*B61B 3/02* (2006.01)
*B61B 13/12* (2006.01)
*B61C 13/04* (2006.01)

(52) U.S. Cl.
CPC ..... *B61B 3/02* (2013.01); *B61B 13/12* (2013.01); *B61C 13/04* (2013.01)

(58) Field of Classification Search
CPC B61B 3/02; B61B 13/04; B61B 13/12; B61B 7/06; B61B 9/00; B61C 15/02
See application file for complete search history.

(56) References Cited

U.S. PATENT DOCUMENTS 4,563,955 A * 1/1986 Tarassoff ..... B61B 12/127 104/168
6,192,803 B1 * 2/2001 Nishino ..... B61C 13/04 104/249

(Continued)

FOREIGN PATENT DOCUMENTS

CN 2048038 U 11/1989
CN 101489849 A 7/2009

(Continued)

OTHER PUBLICATIONS

International Preliminary Report on Patentability, dated Jul. 2, 2014, issued in corresponding International Application No. PCT/EP2013/003414.

(Continued)

*Primary Examiner* — Zachary Kuhfuss
(74) *Attorney, Agent, or Firm* — Andrews Kurth Kenyon LLP

(57) ABSTRACT

A rail system including a rail-bound vehicle, which is able to be moved along a rail track, the rail track being made up of rail components, in particular, the rail-bound vehicle having an electric motor, with the aid of which the rail-bound vehicle is able to be driven, in particular moved along the rail track in the rail direction, one or more pole wheel piece assembly/assemblies being situated in a stationary manner, i.e., connected to the rail track, the rail-bound vehicle having a reaction part, which is able to be brought into operative connection with the pole wheel piece assem- (Continued)

bly, in particular for the purpose of generating a reaction force generated by eddy currents.

15 Claims, 4 Drawing Sheets

(56) References Cited

U.S. PATENT DOCUMENTS

| | | | | |
|---|---|---|---|---|
| 8,347,789 | B2 * | 1/2013 | Wolf | B60L 5/005 104/290 |
| 2007/0044676 | A1 | 3/2007 | Clark et al. | |
| 2009/0013899 | A1 * | 1/2009 | Wolf | B60L 5/005 104/288 |
| 2011/0061558 | A1 * | 3/2011 | Crawford | A63G 7/00 104/53 |

FOREIGN PATENT DOCUMENTS

| | | | | |
|---|---|---|---|---|
| DE | 232 661 | | 3/1911 | |
| DE | 92 00 973 | | 5/1992 | |
| DE | 295 09 605 | | 8/1995 | |
| DE | WO 9641739 | A1 * | 12/1996 | B61B 3/02 |
| DE | 10 2007 037 764 | | 2/2009 | |
| DE | 10 2008 031 153 | | 2/2009 | |
| DE | 10 2009 041 611 | | 4/2011 | |
| DE | 10 2010 048 586 | | 7/2011 | |
| DE | 10 2011 117 118 | | 5/2013 | |
| EP | 0 442 248 | | 8/1991 | |
| EP | 2 172 381 | | 4/2010 | |

OTHER PUBLICATIONS

International Search Report, dated Mar. 7, 2014, issued in corresponding International Application No. PCT/EP2013/003414.

* cited by examiner

RAIL SYSTEM, INCLUDING A RAIL-BOUND VEHICLE MOVABLE ALONG A RAIL TRACK

FIELD OF THE INVENTION

The present invention relates to a rail system, which includes a rail-bound vehicle that is movable along a rail track.

BACKGROUND INFORMATION

It is common knowledge that rail systems include a rail-bound vehicle, which is movable along a rail track.

SUMMARY

Therefore, the present invention is based on the objective of further refining a rail-bound vehicle having the lowest possible mass.

Important features of the present invention in the rail system, which includes a rail-bound vehicle that is movable along a rail track, in which the rail track is made up of rail components, in particular, are that the rail-bound vehicle is equipped with an electric motor, with the aid of which the rail-bound vehicle is able to be driven, especially moved, along the rail track in the track direction, one or more pole wheel piece assembly/assemblies are disposed in a stationary manner, that is to say, connected to the track, the rail-bound vehicle has a reaction part, which is able to be brought into operative connection with the pole wheel piece assembly, in particular for the purpose of producing a reaction force generated by eddy currents.

This has the advantage that a supplementary force amount which overcomes the downgrade force is able to be generated by the pole wheel piece assembly in the individual uphill track segment. As a result, the drive motor of the rail-bound vehicle may have smaller dimensions and the rail-bound vehicle a lower mass.

In one advantageous development, the rail-bound vehicle has a drive, which in particular includes a gear wheel or friction wheel, which is driven by electric motor 5, in particular directly or via a gearing, and cooperates with the rail track; the amount of the feed force that is maximally able to be generated by the drive is smaller than an amount of a downgrade force that occurs in a subregion of the rail track. This has the advantage that a friction wheel drive may be provided, which, however, needs to be configured only for tracks without an uphill gradient. This is due to the fact that at least one pole wheel piece assembly may be installed as supplementary drive in uphill sections in each case.

In one advantageous development, the pole wheel piece assembly is disposed along an uphill track segment, in particular in order to generate an additional feed force for overcoming the downgrade force. This has the advantage that a lower mass may be selected for the drive of the rail-bound vehicle and track segments in the system featuring steep gradients can be traversed nevertheless. In addition, the required power supply to the rail-bound vehicle is low and the conductor line supply may therefore be set up for correspondingly small supplies.

In one advantageous further development, each pole wheel piece assembly has pole wheel pieces driven by a motor, between which at least one gap region is provided, through which a section of the reaction part can be moved. This is advantageous insofar as the immersion of the dipping section of the reaction part may extend virtually up to the outer diameter of the shaft which is driving the pole wheel pieces. A high supplementary drive force is able to be achieved in this manner. The reaction part may be produced from metallic material. The power surge in the initial dip into the gap region is able to be reduced by the design of the reaction part. That is to say, if the dipping leg segment of the reaction part is designed to include a terminal region having a pointed angle and if it dips into the gap region via this angled region, then a very smooth movement of the rail-bound vehicle is possible.

In one advantageous development, each pole wheel piece assembly has pole wheel pieces that are driven by a motor, and a gap exists between two adjacent pole wheel pieces in each case, through which a section of the reaction part can pass. This has the advantage that multiple segments of the reaction part can be driven by multiple pole wheel pieces at the same time, so that high forces are able to be generated.

In one advantageous development, the reaction part has leg sections, and each leg section is able to be plunged into a gap region situated between two pole wheel pieces of a stationary pole wheel piece assembly, and to be moved through this gap region in the direction of the track. This has the advantage that multiple leg sections dip between the pole wheel pieces at the same time. Fitting the latter with permanent magnets on both sides makes it possible to obtain a very compact design.

In one advantageous development, the reaction part is fixed in place on the linkage of the rail-bound vehicle, and the linkage is able to be maneuvered on the rail track or on rail segments of the rail track via wheels supported on the linkage. This has the advantage that the force generated by the supplementary drive is transmitted directly to the rigidly developed linkage of the rail-bound vehicle and may be used for propelling it.

In one advantageous development, the leg segments of the reaction part and/or the gap regions are set apart from each other at regular intervals. This has the advantage that the leg segments of the reactive part are able to be spaced apart in a similar manner. Moreover, a modular development may easily be realized, in which multiple pole wheel pieces are able to be stacked one behind the other.

In one advantageous development, the clearance between pole wheel piece assemblies following each other in the track direction is smaller than the extension of the reaction part in the track direction. This is advantageous insofar as more than just a single pole wheel piece assembly is always active in an uphill track segment.

In one advantageous development, at least two pole wheel piece assemblies spaced apart from each other in the track direction are always in operative connection with the reaction part. This has the advantage that a smooth drive force characteristic is achievable in long uphill track segments.

Additional advantages result from the dependent claims. The present invention is not restricted to the feature combination of the claims. One skilled in the art will find other meaningful combination possibilities of claims and/or individual claim features and/or features of the description and/or the figures, in particular from the posed objective and/or the objective posed in a comparison with the related art.

DETAILED DESCRIPTION

Figure 1:
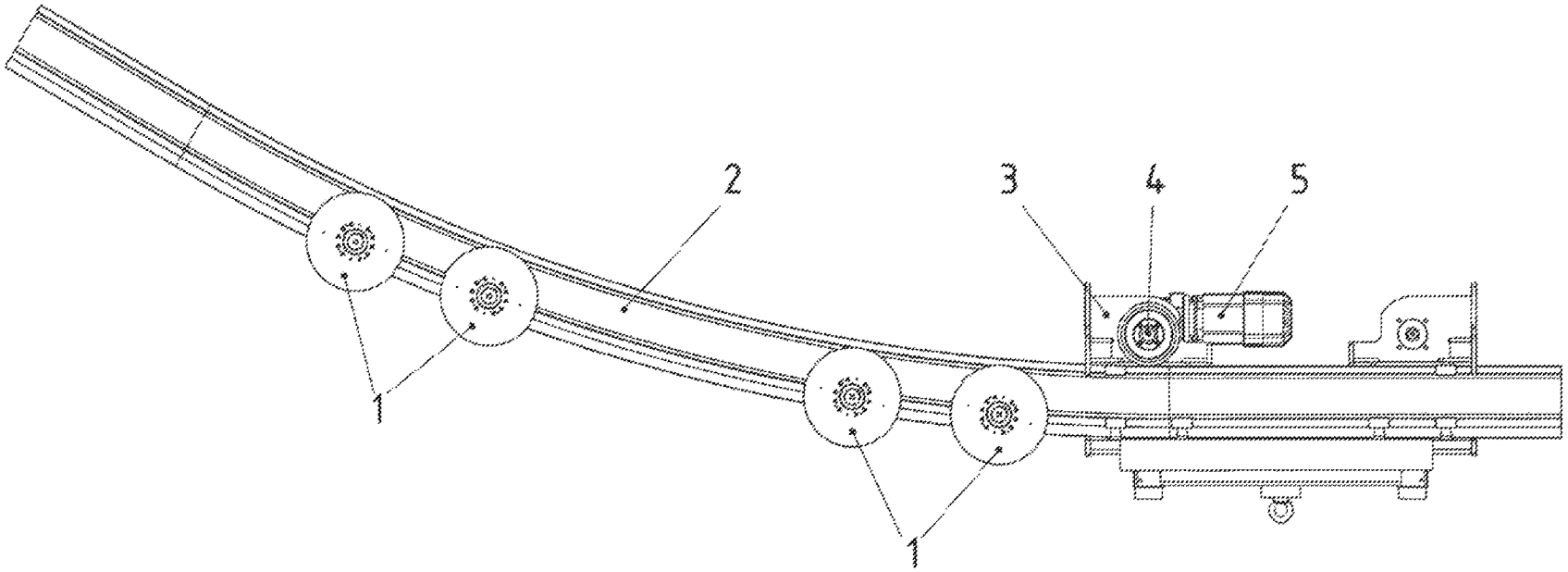
FIG. 1 shows a schematic structure of a rail system, which includes a rail-bound vehicle according to the present invention, reaction part 20 of the rail-bound vehicle not being shown.

The rail system, for example, is a monorail suspension rail.

The rail-bound vehicle has a linkage 3, on which at least one drive wheel is provided, which is able to be driven by an electric motor drive. The drive wheel rolls on rail component 2 of the system and drives the rail-bound vehicle in the manner of a friction wheel drive in the process. Starting at a critical value of the drive torque of the electric motor drive, the drive wheel starts to spin because it loses traction, so that slide friction instead of static friction is active between drive wheel and rail component.

The rail track is made up of rail components 2, which are situated one behind the other. Flat, i.e., non-inclined rail track segments, i.e., in which especially no downgrade force is effective, are provided and uphill track segments as well, i.e., track segments featuring an uphill gradient, in which a downgrade force is acting.

The drive torque of the electric motor drive is dimensioned in such a way that the drive force that is maximally able to be generated by the maximally generatable torque is smaller than the downgrade force in the uphill track segment.

Supplementary drives are therefore available in such an uphill track segment. Pole wheel drives are provided in the individual uphill track section for this purpose.

Each of these stationary pole wheel drives includes a pole wheel piece assembly, whose pole wheel pieces 1 cooperate with a reaction part 20 situated on the rail-bound vehicle.

The distance between pole wheel piece assemblies disposed in the rail direction in the uphill track section is smaller than the length of reaction part 20 in the track direction. When the downgrade force is acting on the rail-bound vehicle, the rail-bound vehicle is therefore always driven by at least two pole wheel piece assemblies situated at a distance from each other in the track direction.

Pole wheel pieces 1 of the individual pole wheel piece assembly are set into rotary motion by a motor, preferably as soon as the rail-bound vehicle reaches the uphill track segment. Sensors, which detect the arrival of the rail-bound vehicle, are provided on the track for this purpose.

The friction-wheel drive of the rail-bound vehicle is driven by an electric motor 5, which is mounted on linkage 3 and drives a gearing, to whose driven shaft 4 the friction wheel is connected in a torsionally fixed manner. The friction wheel is in frictional contact with rail component 2 along which the rail-bound vehicle is guided.

On their side facing the respective reaction part, pole wheel pieces 1 of a particular pole wheel piece assembly carry permanent magnets, which are evenly spaced apart from each other in the circumferential direction of the individual pole wheel piece. These permanent magnets are preferably situated at the same radial distance from the axis of the shaft which is driving pole wheel piece 1, the shaft being connected to the rotor shaft of the motor. The motor is not shown in the figures and preferably developed as electric motor.

Figure 2:
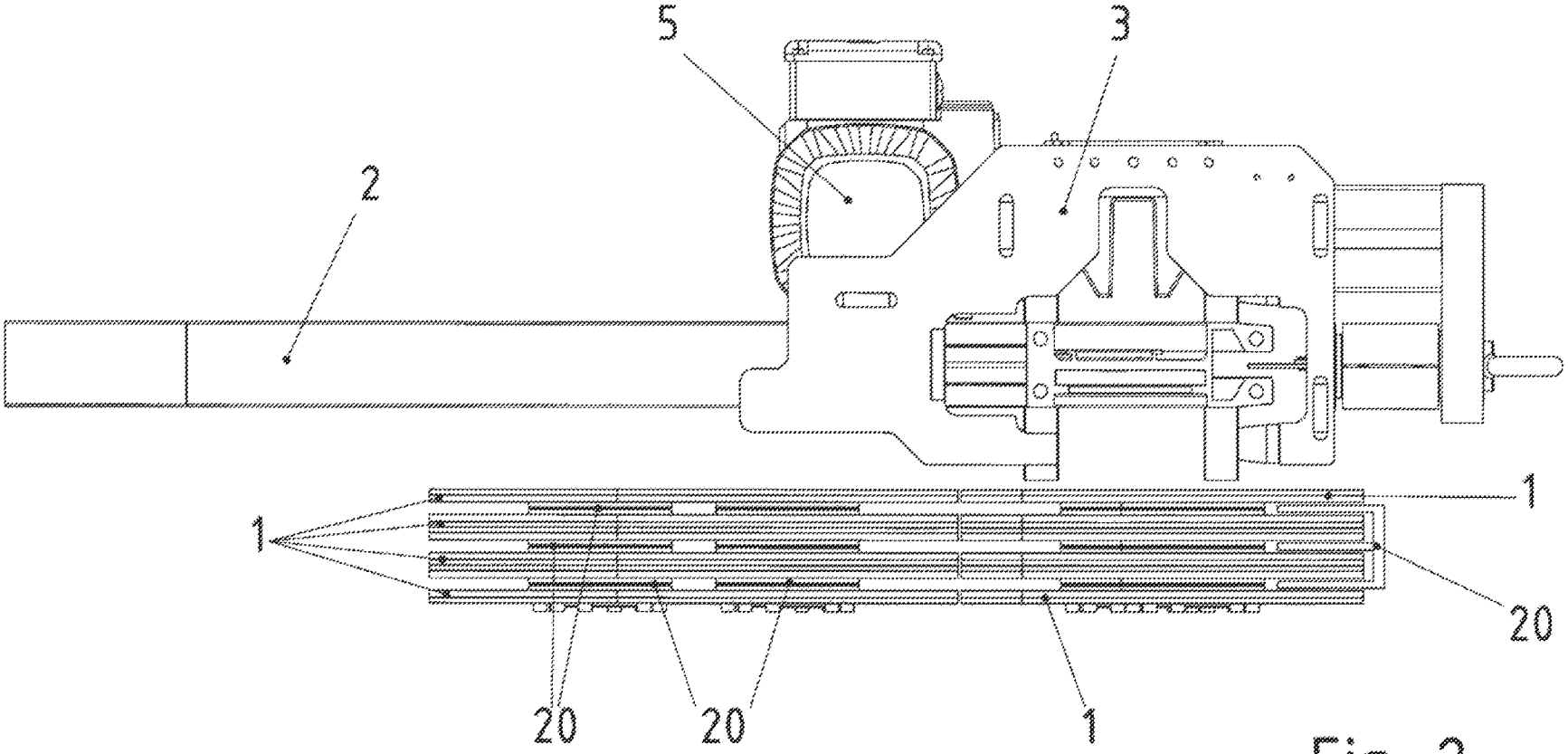
FIG. 2 shows a cross-section, in which reaction part 20 is shown in part.
Figure 3:
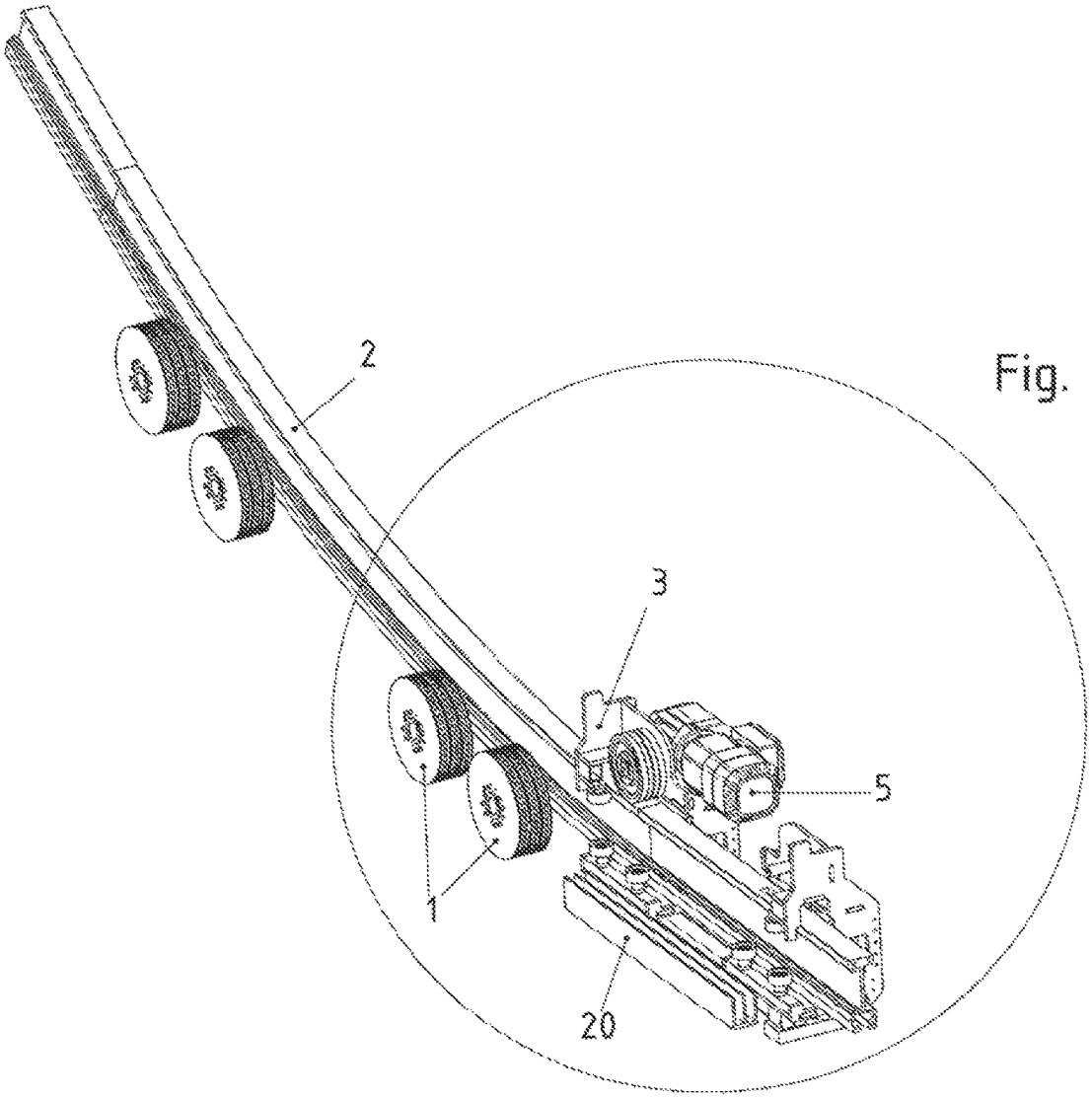
FIG. 3 shows an associated oblique view.
Figure 4:
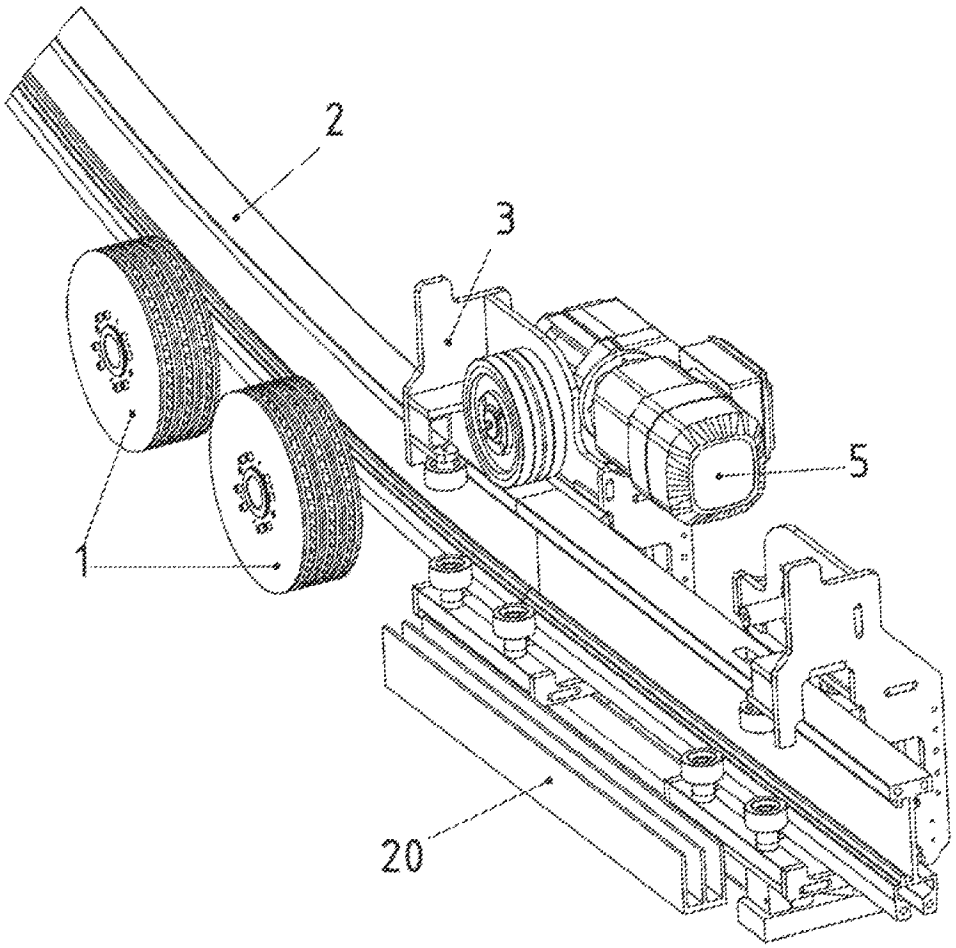
FIG. 4 illustrates an enlarged section of FIG. 3.

As illustrated in FIGS. 2 and 3, multiple pole wheel pieces 1 are disposed on the shaft in each pole wheel piece assembly. The side surfaces of pole wheel pieces 1 facing reaction part 20 and fitted with permanent magnets are spaced apart from each other, so that the reaction part projects between pole wheel pieces 1.

Reaction part 20 has an E-shaped cross-section and an elongated shape in the track direction. As a result, reaction part 20 has two outer leg regions and a center leg region, which are connected via a yoke segment that functions as support segment.

The permanent magnets that are moved relatively past reaction part 20 by pole wheel pieces 1 generate eddy currents in the metal reaction part 20 and thus a feed force as reaction force for the rail-bound vehicle.

The two axially outermost pole wheel pieces 1 require permanent magnets only on their end face surface associated with the particular outer leg of reaction part 20. That is to say, no permanent magnets have to be provided on the side facing away from reaction part 20.

Each leg region of reaction part 20 is able to be developed as a thin sheet metal part, and/or reaction part 20 may be developed as a continuous casting component. Aluminum is preferably used as material for reaction part 20.

In other words, from the direction of the motor, a first pole wheel piece 1 fitted with permanent magnets on one side is situated on the shaft which is able to be set into rotary motion by the motor, and connected thereto in torsionally fixed manner.

Situated on the shaft, on the side of first pole wheel piece 1 facing away from the motor, is a second pole wheel piece 1, which is fitted with permanent magnets on both sides, i.e., axially on both sides. One of the outer sides of reaction part 20 projects between the first and second pole wheel pieces, in particular as closely as possible to the permanent magnets of first and second pole wheel pieces 1. As a result, the outer side of reaction part 20 at least partially covers the same radial clearance region as the region of first and second pole wheel pieces 1 fitted with permanent magnets.

Additionally situated on the shaft, on the side of second pole wheel piece 1 facing away from the motor, is a third pole wheel piece 1, which is fitted with permanent magnets on both sides, i.e., axially on both sides. The center leg of reaction part 20 projects between the third and second pole wheel pieces, especially as closely as possible to the permanent magnets of third and second pole wheel pieces 1. As a result, the center leg of reaction part 20 has at least partially the same radial clearance region as the region of third and second pole wheel piece 1 fitted with permanent magnets.

In addition, on the side of third pole wheel piece 1 facing away from the motor, there is a fourth pole wheel piece 1, which is fitted with permanent magnets on one side, i.e., axially on one side. The other outer leg of reaction part 20 projects between the third and fourth pole wheel pieces, in particular as closely as possible to the permanent magnets of third and fourth pole wheel pieces 1. As a result, the outer leg of reaction part 20 at least partially covers the same radial clearance region as the region of third and fourth pole wheel piece 1 fitted with permanent magnets.

The reaction part is connected to linkage 3 of the rail-bound vehicle and therefore transmits to the rail-bound vehicle the drive force additionally introduced by means of pole wheel pieces 1 cooperating with reaction part 20.

The maximally realizable dipping depth of reaction part 20 is restricted by the outer diameter of the shaft driven by the motor (not shown).

LIST OF REFERENCE NUMERALS

1 pole wheel pieces
2 rail component

3 linkage
4 driven shaft of the gearing
5 electric motor
20 reaction part

The invention claimed is:

1. A rail system, comprising:

a rail track;

a rail-bound vehicle movable along the rail track and including an electric motor, with the aid of which the rail-bound vehicle is able to be driven in a rail direction along the rail track; and at least one pole wheel piece assembly situated in a stationary manner, connected to the rail track, wherein the rail-bound vehicle includes a reaction part that is able to be brought into operative connection with the pole wheel piece assembly, the pole wheel piece assembly adapted to propel the rail-bound vehicle in a forward direction.

2. The rail system as recited in claim 1, wherein the rail track includes rail components.

3. The rail system as recited in claim 1, wherein the rail-bound vehicle has a drive, and cooperates with the rail track, an amount of a feed force maximally able to be generated by the drive being smaller than an amount of a downgrade force occurring in a subregion of the rail track.

4. The rail system as recited in claim 3, wherein the drive includes one of a gear wheel and friction wheel which is driven by the electric motor one of directly and via a gearing.

5. The rail system as recited in claim 1, wherein the pole wheel piece assembly is situated along an uphill track section for the purpose of generating an additional feed force for overcoming a downgrade force.

6. The rail system as recited in claim 1, wherein the reaction part is fixed in place on a linkage of the rail-bound vehicle, and wherein the linkage is able to be maneuvered on one of the rail track and rail sections via wheels supported on the linkage.

7. The rail system according to claim 1, wherein each pole wheel piece assembly adapted to propel the rail-bound vehicle forward and upwardly in a respective upwardly-sloped section of the rail track.

8. The rail system according to claim 1, wherein the pole wheel piece assembly is adapted to propel the rail-bound vehicle in the forward direction while the reaction part is in operative connection with the pole wheel piece assembly.

9. A rail system, comprising:

a rail track;

a rail-bound vehicle movable along the rail track and including an electric motor, with the aid of which the rail-bound vehicle is able to be driven in a rail direction along the rail track; and at least one pole wheel piece assembly situated in a stationary manner, connected to the rail track, wherein the rail-bound vehicle includes a reaction part that is able to be brought into operative connection with the pole wheel piece assembly;

wherein the reaction part is brought into operative connection with the pole wheel assembly for the purpose of producing a reaction force generated by an eddy current.

10. A rail system, comprising:

a rail track;

a rail-bound vehicle movable along the rail track and including an electric motor, with the aid of which the rail-bound vehicle is able to be driven in a rail direction along the rail track; and at least one pole wheel piece assembly situated in a stationary manner, connected to the rail track, wherein the rail-bound vehicle includes a reaction part that is able to be brought into operative connection with the pole wheel piece assembly;

wherein each pole wheel piece assembly includes pole wheel pieces driven by a second motor, between which at least an individual gap region is situated, through which a section of the reaction part is able to travel.

11. A rail system, comprising:

a rail track;

a rail-bound vehicle movable along the rail track and including an electric motor, with the aid of which the rail-bound vehicle is able to be driven in a rail direction along the rail track; and at least one pole wheel piece assembly situated in a stationary manner, connected to the rail track, wherein the rail-bound vehicle includes a reaction part that is able to be brought into operative connection with the pole wheel piece assembly;

wherein each pole wheel piece assembly has pole wheel pieces which are driven by a second motor, and wherein a gap region is disposed between two adjacent pole wheel pieces in each case, through which a particular section of the reaction part is able to travel.

12. A rail system, comprising:

a rail track;

a rail-bound vehicle movable along the rail track and including an electric motor, with the aid of which the rail-bound vehicle is able to be driven in a rail direction along the rail track; and at least one pole wheel piece assembly situated in a stationary manner, connected to the rail track, wherein the rail-bound vehicle includes a reaction part that is able to be brought into operative connection with the pole wheel piece assembly;

wherein the reaction part has leg sections, and wherein each leg section is able to be plunged into a gap region between two pole wheel pieces of an individual pole wheel piece assembly, and be moved through the gap region in a track direction.

13. The rail system as recited in claim 12, wherein at least one of the leg sections of the reaction part and gap regions between two pole wheel pieces of an individual pole wheel piece assembly are spaced apart from each other at regular intervals.

14. A rail system, comprising:

a rail track;

a rail-bound vehicle movable along the rail track and including an electric motor, with the aid of which the rail-bound vehicle is able to be driven in a rail direction along the rail track; and at least one pole wheel piece assembly situated in a stationary manner, connected to the rail track, wherein the rail-bound vehicle includes a reaction part that is able to be brought into operative connection with the pole wheel piece assembly;

wherein the at least one pole wheel assembly includes a plurality of pole wheel assemblies, and wherein intervals between the pole wheel piece assemblies following each other in a track direction are smaller than an extension of the reaction part in the track direction.

15. A rail system, comprising:

a rail track;

a rail-bound vehicle movable along the rail track and including an electric motor, with the aid of which the rail-bound vehicle is able to be driven in a rail direction along the rail track; and at least one pole wheel piece assembly situated in a stationary manner, connected to the rail track, wherein the rail-bound vehicle includes a reaction part that is able to be brought into operative connection with the pole wheel piece assembly;

wherein in an uphill track section, at least two pole wheel piece assemblies situated at a distance from each other in a track direction are always in operative connection with the reaction part.

* * * * *